US008966933B2

(12) United States Patent
Okamoto et al.

(10) Patent No.: US 8,966,933 B2
(45) Date of Patent: Mar. 3, 2015

(54) REFRIGERATION APPARATUS

(71) Applicant: Daikin Industries, Ltd., Osaka-shi, Osaka (JP)

(72) Inventors: Tetsuya Okamoto, Sakai (JP); Kazuhiro Furusho, Sakai (JP); Ikuhiro Iwata, Sakai (JP); Guozhong Yang, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/365,997

(22) PCT Filed: Dec. 26, 2012

(86) PCT No.: PCT/JP2012/083560

§ 371 (c)(1),
(2) Date: Jun. 16, 2014

(87) PCT Pub. No.: WO2013/099895

PCT Pub. Date: Jul. 4, 2013

(65) Prior Publication Data

US 2014/0311177 A1 Oct. 23, 2014

(30) Foreign Application Priority Data

Dec. 28, 2011 (JP) ..... 2011-290110

(51) Int. Cl.
*F25B 43/02* (2006.01)
*F25B 1/10* (2006.01)
*F25B 29/00* (2006.01)

(52) U.S. Cl.
CPC . *F25B 43/02* (2013.01); *F25B 1/10* (2013.01); *F25B 29/003* (2013.01)
USPC ..... 62/470; 62/510; 62/196.2

(58) Field of Classification Search
CPC ..... F25B 29/003; F25B 2400/02; F25B 1/10; F25B 43/02; F25B 2500/16; F25B 1/004
USPC ..... 62/84, 192, 193, 324.6, 470, 510, 62/196.2, 159, 196.1, 196.3, 468, 472
See application file for complete search history.

(56) References Cited

U.S. PATENT DOCUMENTS

2010/0242529 A1* 9/2010 Fujimoto et al. ..... 62/470

FOREIGN PATENT DOCUMENTS

JP 2009-97847 A 5/2009
JP 2009-257704 A 11/2009

(Continued)

OTHER PUBLICATIONS

International Search Report of corresponding PCT Application No. PCT/JP2012/083560.

(Continued)

*Primary Examiner* — Cheryl J Tyler
*Assistant Examiner* — Ana Vazquez
(74) *Attorney, Agent, or Firm* — Global IP Counselors

(57) ABSTRACT

A refrigeration apparatus includes a multistage compression mechanism, switching mechanisms, intercoolers, oil separators, and a control unit. The multistage compression mechanism has one high-stage-side compression mechanism and a plurality of low-stage-side compression mechanisms connected in series. The switching mechanisms are connected to blow-out pipes of the low-stage-side compression mechanisms. The switching mechanisms switch between cooling and heating operation cycles. The intercoolers cool refrigerant blown out from the low-stage-side compression mechanisms during the cooling cycle. The oil separators are disposed between the switching mechanisms and the intercoolers. The oil separators separate lubricating oil from refrigerant blown out from the low-stage-side compression mechanisms during the cooling cycle. The control unit controls the multi-stage compression mechanism and the switching mechanisms. Refrigerant from the low-stage-side compression mechanisms passes through the oil separators and intercoolers during the cooling cycle, not during the heating cycle.

12 Claims, 6 Drawing Sheets

(56) References Cited

FOREIGN PATENT DOCUMENTS

| | | | |
|---|---|---|---|
| JP | 2009-257705 | A | 11/2009 |
| JP | 2010-156493 | A | 7/2010 |
| JP | 2012-141131 | A | 7/2012 |

OTHER PUBLICATIONS

International Preliminary Report of corresponding PCT Application No. PCT/JP2012/083560 dated Jul. 10, 2014.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2011-290110, filed in Japan on Dec. 28, 2011, the entire contents of which are hereby incorporated herein by reference.

TECHNICAL FIELD

The present invention relates to a refrigeration apparatus.

BACKGROUND ART

There is conventionally used a refrigeration apparatus comprising a refrigerant circuit for carrying out a multistage compression refrigeration cycle, being a refrigeration apparatus provided with an intercooler and an oil separator. The intercooler cools a compressed refrigerant blown out from each stage of compression mechanism other than that of the highest stage. The oil separator separates a lubricating oil from the compressed refrigerant blown out from the compression mechanism in order to reduce the amount of oil rising at each stage during the cooling operation. The oil separator is usually installed on piping on a blow-out side of the compression mechanism, as is disclosed in Japanese Laid-open Patent Application No. 2009-257704.

SUMMARY

Technical Problem

However, in the refrigeration apparatus described in Japanese Laid-open Patent Application No. 2009-257704, the intercooler is not used for the purpose of cooling the compressed refrigerant during the heating operation. Therefore, the compressed refrigerant blown out from a compression mechanism other than that of the highest stage does not require the lubricating oil to be separated by the oil separator during the heating operation. The compressed refrigerant also releases heat by being exposed to low-temperature external air when passing through the oil separator, which is placed outdoors. Thermal loss is therefore incurred in the oil separator. Accordingly, a problem arises that the heating capacity of the refrigeration circuit decreases and the efficiency of the refrigeration apparatus as a whole degrades.

An object of the present invention is to provide a refrigeration apparatus in which exothermic loss can be suppressed.

Solution to Problem

A refrigeration apparatus according to a first aspect of the present invention comprises a multistage compression mechanism, switching mechanisms, intercoolers, low-stage-side oil separators, and a control unit. In the multistage compression mechanism, one high-stage-side compression mechanism and a plurality of low-stage-side compression mechanisms are connected in series. The switching mechanisms are connected to blow-out pipes of the low-stage-side compression mechanisms. The switching mechanisms are configured to switch between a cooling operation cycle and a heating operation cycle. The intercoolers are configured to cool a refrigerant blown out from the low-stage-side compression mechanisms during the cooling operation cycle. The low-stage-side oil separators are placed between the switching mechanisms and the intercoolers. The low-stage-side oil separators are configured to separate a lubricating oil from the refrigerant blown out from the low-stage-side compression mechanisms during the cooling operation cycle. The control unit is configured to control the multistage compression mechanism and the switching mechanisms.

The refrigeration apparatus according to the first aspect comprises a multistage compression mechanism having three or more compression mechanisms connected in series. The multistage compression mechanism includes a high-stage-side compression mechanism, being a compression mechanism at a highest stage, and low-stage-side compression mechanisms, being compression mechanisms other than the high-stage-side compression mechanism. During the cooling operation cycle, the refrigerant compressed by a low-stage-side compression mechanisms passes through a four-way switching valve or other switching mechanism and is supplied to a low-stage-side oil separator. The compressed refrigerant having the lubricating oil separated by the low-stage-side oil separator is supplied to an intercooler. The compressed refrigerant cooled in the intercooler is supplied to a compression mechanism at a higher stage and is further compressed. That is, the low-stage-side oil separator is placed between the switching mechanism connected to the low-stage-side compression mechanism, and the intercooler. The low-stage-side oil separator prevents the lubricating oil from flowing into the intercooler and lowering the cooling performance of the intercooler.

In the refrigeration apparatus comprising the multistage compression mechanism, the refrigerant compressed in each stage of compression mechanism other than that of the highest stage is not cooled in the intercooler during the heating operation cycle, and therefore there is no requirement for the lubricating oil to be separated by the oil separator. In the refrigeration apparatus according to the first aspect, during the heating operation cycle, the refrigerant compressed in a low-stage-side compression mechanism passes through the switching mechanism without passing through the low-stage-side oil separator, and is sent to a compression mechanism at a higher stage. That is, in the heating operation cycle, the refrigerant compressed in the low-stage-side compression mechanism is prevented from releasing heat into the low-temperature external air and incurring thermal loss in the low-stage-side oil separator. Accordingly, in the refrigeration apparatus according to the first aspect, exothermic loss can be suppressed.

A refrigeration apparatus according to a second aspect of the present invention is the refrigeration apparatus according to the first aspect, further comprising a high-stage-side oil separator. The high-stage-side oil separator is connected to a blow-out pipe of the high-stage-side compression mechanism. The high-stage-side oil separator is configured to separate the lubricating oil from the refrigerant blown out from the high-stage-side compression mechanism.

A refrigeration apparatus according to a third aspect of the present invention is the refrigeration apparatus according to the first or second aspect, further comprising cooling oil return lines and heating oil return lines. The cooling oil return lines return the lubricating oil separated from the refrigerant in the low-stage-side oil separator to a blow-out side of the intercooler connected to the low-stage-side oil separator. The heating oil return lines return the lubricating oil separated from the refrigerant in the low-stage-side oil separator to a refrigerant blow-out side of the low-stage-side oil separator during the heating operation cycle.

The refrigeration apparatus according to the third aspect has two routes through which the lubricating oil separated from the refrigerant in the low-stage-side oil separator is returned. In the cooling operation cycle, the lubricating oil separated in the low-stage-side oil separator bypasses the intercooler and is returned to the piping on the intake side of a compression mechanism at a higher stage. During the heating operation cycle, the lubricating oil separated in the low-stage-side oil separator is returned to the piping of the low-stage-side oil separator where the refrigerant having the lubricating oil separated is blown out. Accordingly, in the refrigeration apparatus according to the third aspect, the lubricating oil separated in the oil separator can be returned to a suitable flow of refrigerant.

The refrigeration apparatus according to a fourth aspect of the present invention is the refrigeration apparatus according to the third aspect, wherein the cooling oil return lines have cooling backflow prevention mechanisms that allow only a flow of the lubricating oil during the cooling operation cycle. The heating oil return lines have heating backflow prevention mechanisms that allow only a flow of the lubricating oil during the heating operation cycle.

The refrigeration apparatus according to a fifth aspect of the present invention is the refrigeration apparatus according to any of the first to fourth aspects, wherein the low-stage-side compression mechanisms include a first low-stage-side compression mechanism, a second low-stage-side compression mechanism, and a third low-stage-side compression mechanism. The multistage compression mechanism has the high-stage-side compression mechanism, the first low-stage-side compression mechanism, the second low-stage-side compression mechanism, and the third low-stage-side compression mechanism connected in series in the stated order. That is, this refrigeration apparatus comprises a four-stage compression mechanism.

Advantageous Effects of Invention

In the refrigeration apparatus according to the first and second aspects of the present invention, exothermic loss can be suppressed.

In the refrigeration apparatus according to the third and fourth aspects of the present invention, the lubricating oil separated in the oil separator can be returned to a suitable flow of refrigerant.

The refrigeration apparatus according to the fifth aspect of the present invention can be applied to a refrigeration apparatus comprising a four-stage compression mechanism.

DESCRIPTION OF EMBODIMENTS

Figure 1:
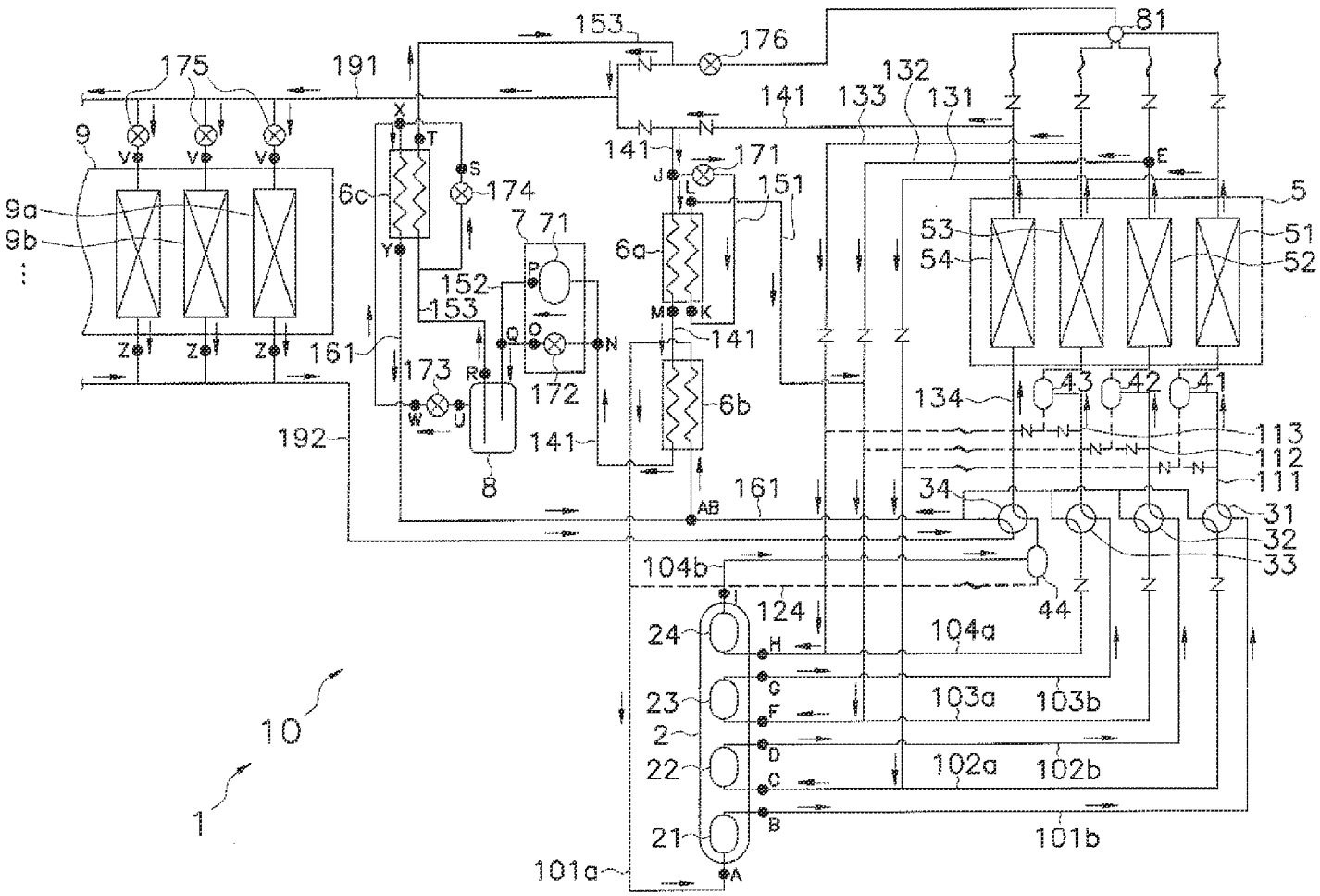
FIG. 1 is a schematic diagram of an air-conditioning apparatus according to an embodiment of the present invention during a cooling operation.

A refrigeration apparatus according to an embodiment of the present invention is described while referring to the drawings.

(1) Configuration of an Air-Conditioning Apparatus

Figure 4:
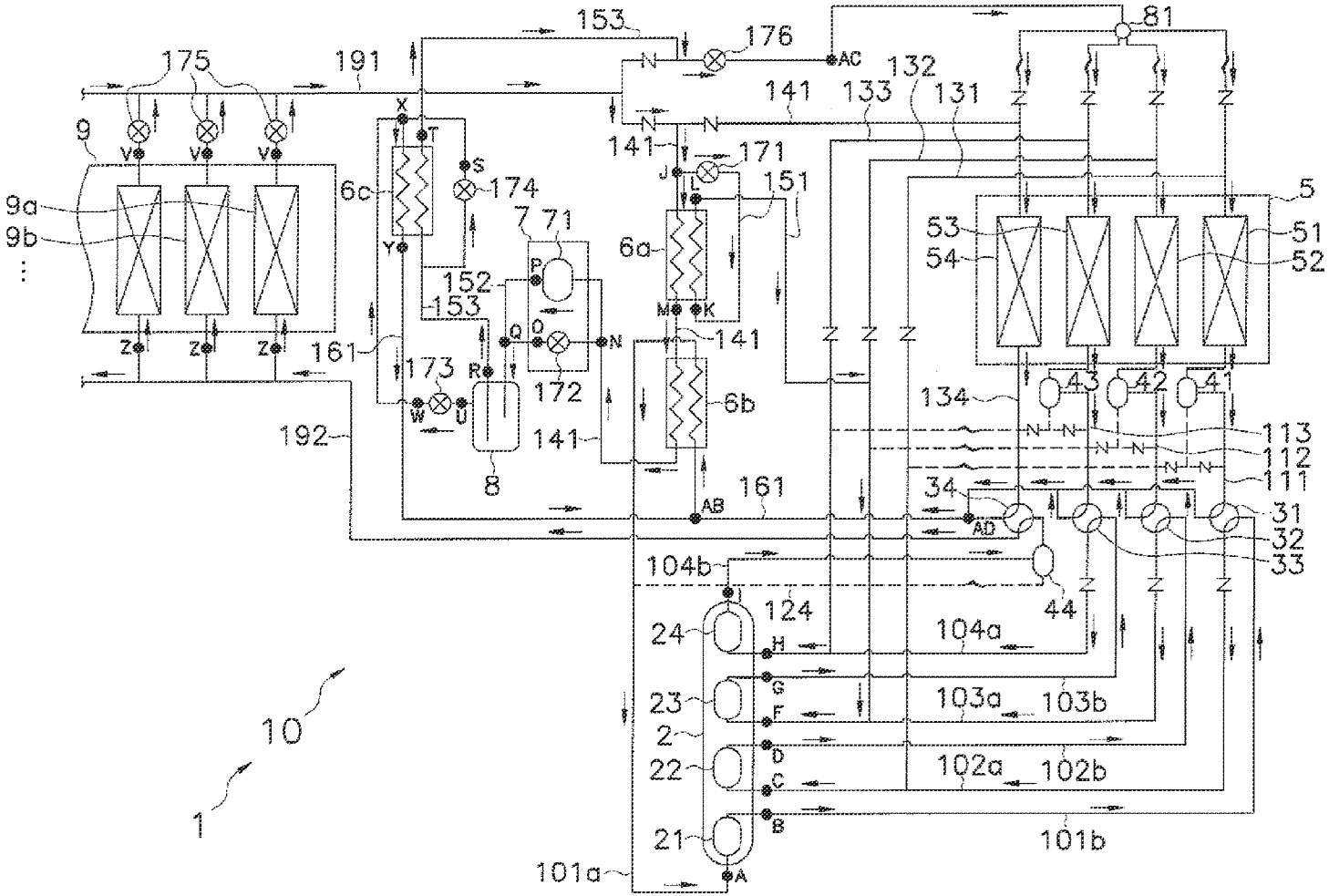
FIG. 4 is a schematic diagram of an air-conditioning apparatus according to an embodiment of the present invention during a heating operation.

FIG. 1 and FIG. 4 are schematic diagrams of an air-conditioning apparatus 1 as one embodiment of a refrigeration apparatus according to the present invention. The air-conditioning apparatus 1 is a refrigeration apparatus that carries out a four-stage compression refrigeration cycle using a carbon dioxide refrigerant in a supercritical state. The air-conditioning apparatus 1 has a refrigerant circuit 10 configured to be switchable between a cooling operation cycle and a heating operation cycle. FIG. 1 represents the flow of refrigerant circulating in the refrigerant circuit 10 during the cooling operation. FIG. 4 represents the flow of refrigerant circulating in the refrigerant circuit 10 during the heating operation. In FIGS. 1 and 4, the arrows following the piping of the refrigerant circuit 10 represent the flow of refrigerant.

The refrigerant circuit 10 of the air-conditioning apparatus 1 mainly includes a four-stage compressor 2, a first switching mechanism 31, a second switching mechanism 32, a third switching mechanism 33, a fourth switching mechanism 34, a first oil separator 41, a second oil separator 42, a third oil separator 43, a fourth oil separator 44, an outdoor heat exchanger 5, an economizer heat exchanger 6*a*, a liquid-gas heat exchanger 6*b*, an expansion mechanism 7, a receiver 8, a super-cooling heat exchanger 6*c*, an indoor heat exchanger 9, and a control unit (not illustrated). The constituents of the refrigerant circuit 10 are next described in detail.

(1-1) Four-Stage Compressor

The four-stage compressor 2 is a sealed-type compressor in which a first compression mechanism 21, a second compression mechanism 22, a third compression mechanism 23, a fourth compression mechanism 24, a compressor drive motor (not illustrated), and a drive shaft (not illustrated) are housed inside a sealed container. The compressor drive motor is coupled to the drive shaft. The drive shaft is coupled to the four compression mechanisms 21 to 24. That is, the four-stage compressor 2 has a uniaxial four-stage compression structure in which the four compression mechanisms 21 to 24 are coupled to a single drive shaft. In the four-stage compressor 2, the first compression mechanism 21, the second compression mechanism 22, the third compression mechanism 23, and the fourth compression mechanism 24 are connected in series in the stated order. The first compression mechanism 21 is connected to a first intake pipe 101*a* and a first blow-out pipe 101*b*. The second compression mechanism 22 is connected to a second intake pipe 102*a* and a second blow-out pipe 102*b*. The third compression mechanism 23 is connected to a third intake pipe 103*a* and a third blow-out pipe 103*b*. The fourth compression mechanism 24 is connected to a fourth intake pipe 104*a* and a fourth blow-out pipe 104*b*.

The first compression mechanism 21 is the compression mechanism at the lowest stage, and compresses the refrigerant having the lowest pressure flowing in the refrigerant circuit 10. The second compression mechanism 22 compresses the refrigerant compressed by the first compression mechanism 21. The third compression mechanism 23 compresses the refrigerant compressed by the second compression mechanism 22. The fourth compression mechanism 24 is the compression mechanism at the highest stage, and compresses the refrigerant compressed by the third compression mechanism 23. The refrigerant compressed by the fourth compression mechanism 24 is the refrigerant having the highest pressure flowing in the refrigerant circuit 10.

In the present embodiment, the compression mechanism 21 to 24 are rotary-type compression mechanisms. The compressor drive motor is connected to the control unit. That is, an operating speed, and the like, of the compression mechanisms 21 to 24 are controlled by the control unit.

(1-2) First to Fourth Switching Mechanisms

The first switching mechanism 31 is connected with the first blow-out pipe 101*b*, the second intake pipe 102*a*, a first oil separation pipe 111, and a low-pressure refrigerant pipe 161. The second switching mechanism 32 is connected with the second blow-out pipe 102*b*, the third intake pipe 103*a*, a second oil separation pipe 112, and the low-pressure refrigerant pipe 161. The third switching mechanism 33 is connected with the third blow-out pipe 103*b*, the fourth intake pipe 104*a*, a third oil separation pipe 113, and the low-pressure refrigerant pipe 161. The fourth switching mechanism 34 is connected with the fourth blow-out pipe 104*b*, a gas cooler pipe 134, a second indoor heat exchange pipe 192, and the low-pressure refrigerant pipe 161.

The first switching mechanism 31, second switching mechanism 32, third switching mechanism 33, and fourth switching mechanism 34 are a four-way switching valve for switching the direction of flow of the refrigerant in the refrigerant circuit 10 to switch between the cooling operation cycle and the heating operation cycle. During the cooling operation, the switching mechanisms 31 to 34 enable the outdoor heat exchanger 5 to function as a cooler of the refrigerant compressed by the four-stage compressor 2 and enable the indoor heat exchanger 9 to function as a heater of the refrigerant passing through the expansion mechanism 7 and being expanded. During the heating operation, the switching mechanisms 31 to 34 enable the indoor heat exchanger 9 to function as a cooler of the refrigerant compressed by the four-stage compressor 2 and enable the outdoor heat exchanger 5 to function as a heater of the refrigerant passing through the expansion mechanism 7 and being expanded.

That is, the switching mechanisms 31 to 34, considering only on the four-stage compressor 2, the outdoor heat exchanger 5, the expansion mechanism 7, and the indoor heat exchanger 9 as constituents of the refrigerant circuit 10, switches a cooling operation cycle in which the refrigerant is circulated in the order of the four-stage compressor 2, outdoor heat exchanger 5, expansion mechanism 7, and indoor heat exchanger 9, and a heating operation cycle in which the refrigerant is circulated in the order of the four-stage compressor 2, indoor heat exchanger 9, expansion mechanism 7, and outdoor heat exchanger 5.

(1-3) First to Fourth Oil Separators

The first oil separator 41, the second oil separator 42, the third oil separator 43, and the fourth oil separator 44 are a mechanism for separating lubricating oil contained in the refrigerant circulating in the refrigerant circuit 10. The lubricating oil is refrigerator oil used for lubricating sliding parts, and the like, of the four-stage compressor 2. When the refrigerant containing the lubricating oil flows into and accumulates in the outdoor heat exchanger 5 and the indoor heat exchanger 9, the efficiency of heating and cooling of the refrigerant decreases and the performance of the air-conditioning apparatus 1 degrades. The oil separators 41 to 44 suitably return the lubricating oil separated from the refrigerant to the refrigerant circuit 10.

Figure 2:
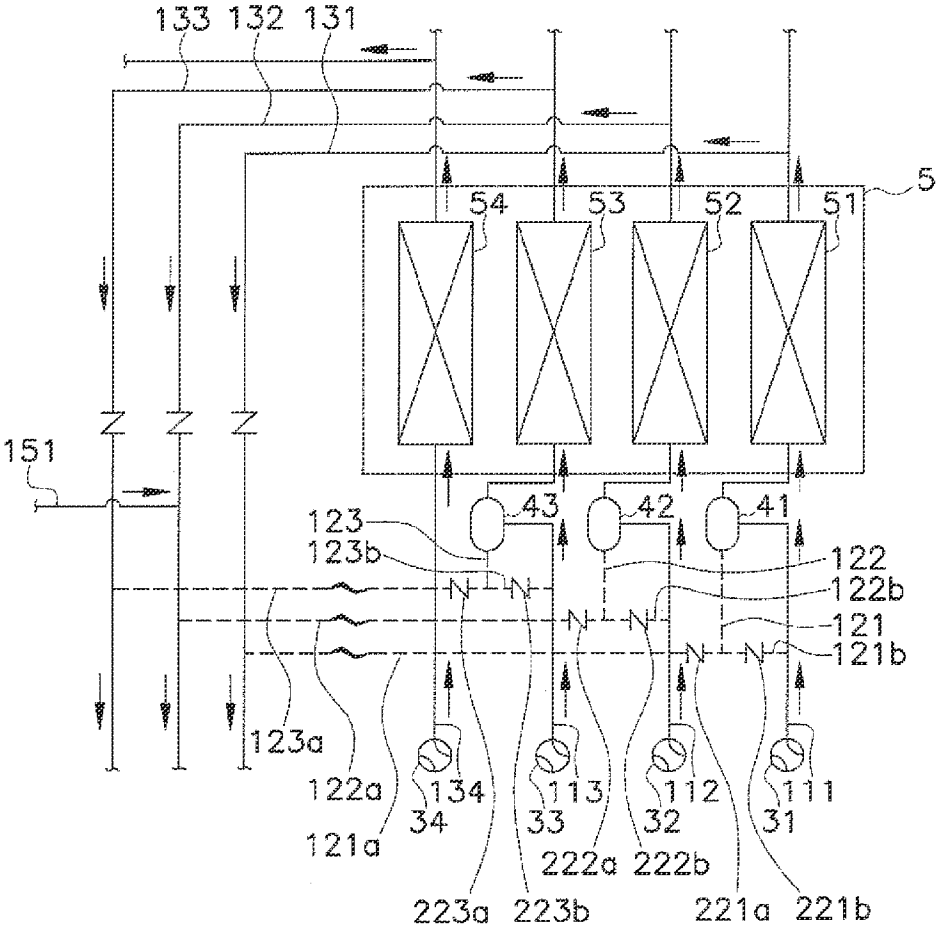
FIG. 2 is a diagram representing piping surrounding the first to third oil separators in FIG. 1.
Figure 5:
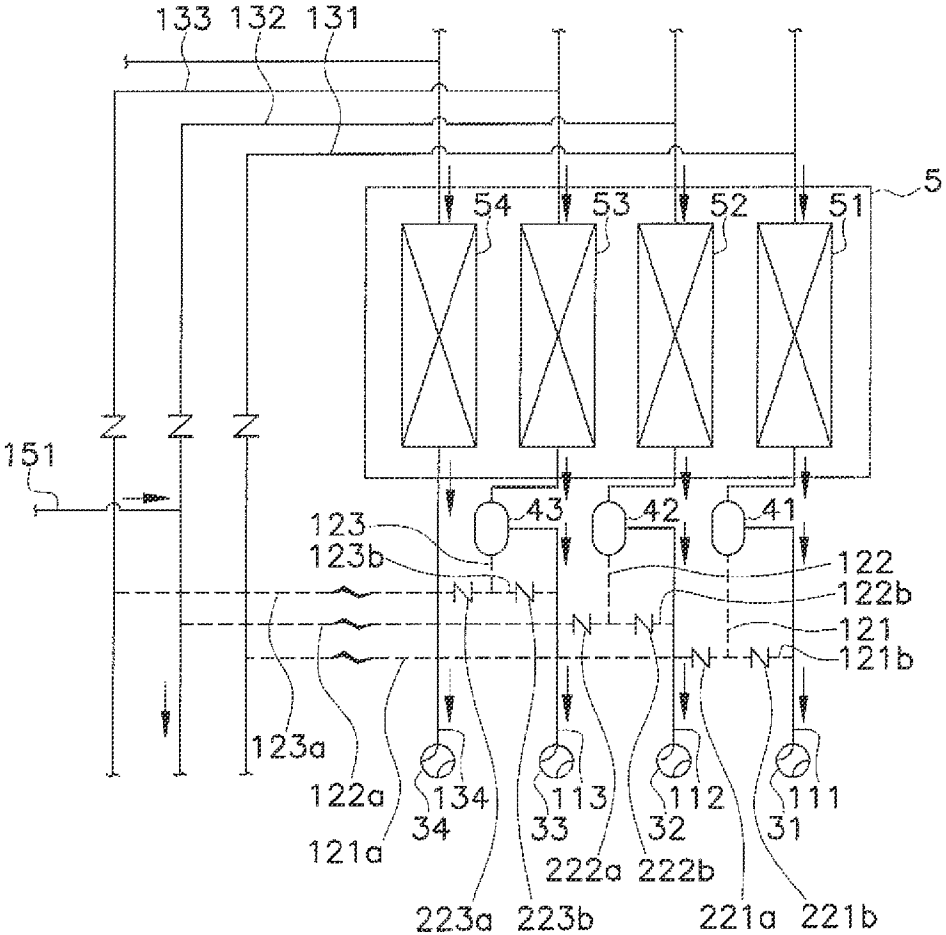
FIG. 5 is a diagram representing piping surrounding the first to third oil separators in FIG. 4.

FIG. 2 is a diagram representing the piping surrounding the first oil separator 41, second oil separator 42, and third oil separator 43 illustrated in FIG. 1 representing the cooling operation cycle. FIG. 5 is a diagram representing the piping surrounding the first oil separator 41, second oil separator 42, and third oil separator 43 illustrated in FIG. 4 representing the heating operation cycle. In FIGS. 2 and 5, the arrows following the piping of the refrigerant circuit 10 represent the flow of refrigerant. The explanation is given below while referring to FIGS. 2 and 5.

The first oil separator 41 is installed on a first oil separation pipe 111, and is connected to a first oil return pipe 121. The first oil separator 41 separates the lubricating oil from the refrigerant flowing in the first oil separation pipe 111 and supplies the separated lubricating oil to the first oil return pipe 121. The first oil return pipe 121 branches to a first cooling oil return pipe 121*a* and a first heating oil return pipe 121*b*. The first cooling oil return pipe 121*a* has installed a first cooling backflow prevention valve 221*a*, and is connected to a first intercooler pipe 131. The first heating oil return pipe 121*b* has installed a first heating backflow prevention valve 221*b*, and is connected to the first oil separation pipe 111 connecting the first switching mechanism 31 and the first oil separator 41.

The second oil separator 42 is installed on a second oil separation pipe 112, and is connected to a second oil return pipe 122. The second oil separator 42 separates the lubricating oil from the refrigerant flowing in the second oil separation pipe 112 and supplies the separated lubricating oil to the second oil return pipe 122. The second oil return pipe 122 branches to a second cooling oil return pipe 122*a* and a second heating oil return pipe 122*b*. The second cooling oil return pipe 122*a* has installed a second cooling backflow prevention valve 222*a*, and is connected to a second intercooler pipe 132. The second heating oil return pipe 122*b* has installed a second heating backflow prevention valve 222*b*, and is connected to the second oil separation pipe 112 connecting the second switching mechanism 32 and the second oil separator 42.

The third oil separator 43 is installed on a third oil separation pipe 113, and is connected to a third oil return pipe 123. The third oil separator 43 separates the lubricating oil from the refrigerant flowing in the third oil separation pipe 113 and supplies the separated lubricating oil to the third oil return pipe 123. The third oil return pipe 123 branches to a third cooling oil return pipe 123*a* and a third heating oil return pipe 123*b*. The third cooling oil return pipe 123*a* has installed a third cooling backflow prevention valve 223*a*, and is connected to a third intercooler pipe 133. The third heating oil return pipe 123*b* has installed a third heating backflow prevention valve 223*b*, and is connected to the third oil separation pipe 113 connecting the third switching mechanism 33 and the third oil separator 43.

The fourth oil separator 44 is installed on a fourth blow-out pipe 104*b*, and is connected to a fourth oil return pipe 124. The fourth oil separator 44 separates the lubricating oil from the refrigerant flowing in the fourth blow-out pipe 104*b*, supplies the separated lubricating oil to the fourth oil return pipe 124, and sends the refrigerant having the lubricating oil separated to the fourth switching mechanism 34. The fourth oil return pipe 124 is connected to a first intake pipe 101*a*.

The first cooling backflow prevention valve 221*a*, the second cooling backflow prevention valve 222*a*, and the third cooling backflow prevention valve 223*a* are a backflow prevention mechanism that allows only passage of the lubricating oil during the cooling operation. The first heating backflow prevention valve 221*b*, the second heating backflow prevention valve 222*b*, and the third heating backflow prevention valve 223*b* are a backflow prevention mechanism that allows only passage of the lubricating oil during the heating operation.

(1-4) Outdoor Heat Exchanger

The outdoor heat exchanger 5 is configured with a first intercooler 51, a second intercooler 52, a third intercooler 53, and a gas cooler 54. The outdoor heat exchanger 5 functions as a cooler of refrigerant during the cooling operation and functions as a heater of refrigerant during the heating operation. The outdoor heat exchanger 5 is supplied with water, air, and the like, as a medium to undergo heat exchange with the refrigerant flowing inside.

The first intercooler 51 is connected to the first oil separation pipe 111 and the first intercooler pipe 131. The second intercooler 52 is connected to the second oil separation pipe 112 and the second intercooler pipe 132. The third intercooler 53 is connected to the third oil separation pipe 113 and the third intercooler pipe 133. The gas cooler 54 is connected to the gas cooler pipe 134 and piping inside the refrigerant circuit 10 communicating with a high-pressure refrigerant pipe 141.

(1-5) Economizer Heat Exchanger

The economizer heat exchanger 6*a* is connected to the high-pressure refrigerant pipe 141 and a first intermediate-pressure refrigerant pipe 151. The first intermediate-pressure refrigerant pipe 151 branches from the high-pressure refrigerant pipe 141, and has installed a first expansion valve 171. The economizer heat exchanger 6*a* carries out heat exchange between high-pressure refrigerant flowing in the high-pressure refrigerant pipe 141 and intermediate-pressure refrigerant passing through the first expansion valve 171 and flowing in the first intermediate-pressure refrigerant pipe 151.

(1-6) Liquid-Gas Heat Exchanger

The liquid-gas heat exchanger 6*b* is connected to the high-pressure refrigerant pipe 141 and a low-pressure refrigerant pipe 161. The liquid-gas heat exchanger 6*b* carries out heat exchange between high-pressure refrigerant passing through the economizer heat exchanger 6*a* and flowing in the high-pressure refrigerant pipe 141 and low-pressure refrigerant passing through the expansion mechanism 7, or the like, and flowing in the low-pressure refrigerant pipe 161.

(1-7) Expansion Mechanism

The expansion mechanism 7 depressurizes high-pressure refrigerant passing through the liquid-gas heat exchanger 6*b* and flowing in the high-pressure refrigerant pipe 141, and supplies intermediate-pressure refrigerant in a liquid-gas two-phase state to a second intermediate-pressure refrigerant pipe 152. The intermediate-pressure refrigerant flowing in the second intermediate-pressure refrigerant pipe 152 is sent to the receiver 8. The expansion mechanism 7 is configured with a second expansion valve 172 and an expander 71.

(1-8) Receiver

The receiver 8 separates the intermediate-pressure refrigerant in a liquid-gas two-phase state, sent from the expansion mechanism 7 by way of the second intermediate-pressure refrigerant pipe 152, into liquid refrigerant and gas refrigerant. The separated gas refrigerant passes through a third expansion valve 173 and becomes low-pressure gas refrigerant, is supplied to the low-pressure refrigerant pipe 161, and is sent to the super-cooling heat exchanger 6*c*. The separated liquid refrigerant is supplied to a third intermediate-pressure refrigerant pipe 153 and is sent to the super-cooling heat exchanger 6*c*.

(1-9) Super-Cooling Heat Exchanger

The super-cooling heat exchanger 6*c* carries out heat exchange between intermediate-pressure refrigerant flowing in the third intermediate-pressure refrigerant pipe 153 and low-pressure refrigerant flowing in the low-pressure refrigerant pipe 161. The third intermediate-pressure refrigerant pipe 153 branches at midcourse and is connected to the low-pressure refrigerant pipe 161 by way of a fourth expansion valve 174. That is, a part of the intermediate-pressure refrigerant flowing in the third intermediate-pressure refrigerant pipe 153 passes through the fourth expansion valve 174 and becomes low-pressure refrigerant, is supplied to the low-pressure refrigerant pipe 161, and is sent to the super-cooling heat exchanger 6*c*.

(1-10) Indoor Heat Exchanger

The indoor heat exchanger 9 is configured with a plurality of indoor heat exchange units 9*a*, 9*b*, . . . . The indoor heat exchanger 9 functions as a heater of refrigerant during the cooling operation and functions as a cooler of refrigerant during the heating operation. The indoor heat exchanger 9 is supplied with water, air, and the like, as a medium to undergo heat exchange with the refrigerant flowing inside.

Each indoor heat exchange unit 9*a*, 9*b*, . . . is connected to a first indoor heat exchange pipe 191 and a second indoor heat exchange pipe 192. A fifth expansion valve 175 is installed respectively on each bypass pipe on the first indoor heat exchange pipe 191 connected to each indoor heat exchange unit 9*a*, 9*b*, . . . . During the cooling operation, the first indoor heat exchange pipe 191 communicates with the third intermediate-pressure refrigerant pipe 153, and the second indoor heat exchange pipe 192 communicates with the low-pressure refrigerant pipe 161 by way of the fourth switching mechanism 34. During the heating operation, the first indoor heat exchange pipe 191 communicates with the high-pressure refrigerant pipe 141, and the second indoor heat exchange pipe 192 communicates with the fourth blow-out pipe 104*b* by way of the fourth switching mechanism 34.

(1-11) Control Unit

The control unit is a microcomputer connected to a compressor drive motor for driving a drive shaft coupled to the four compression mechanisms 21 to 24 configuring the four-stage compressor 2, and connected to the switching mechanisms 31 to 34. The control unit controls operating speeds of the compression mechanisms 21 to 24, switching between the cooling operation cycle and the heating operation cycle, and the like.

(2) Operation of the Air-Conditioning Apparatus

Figure 3:
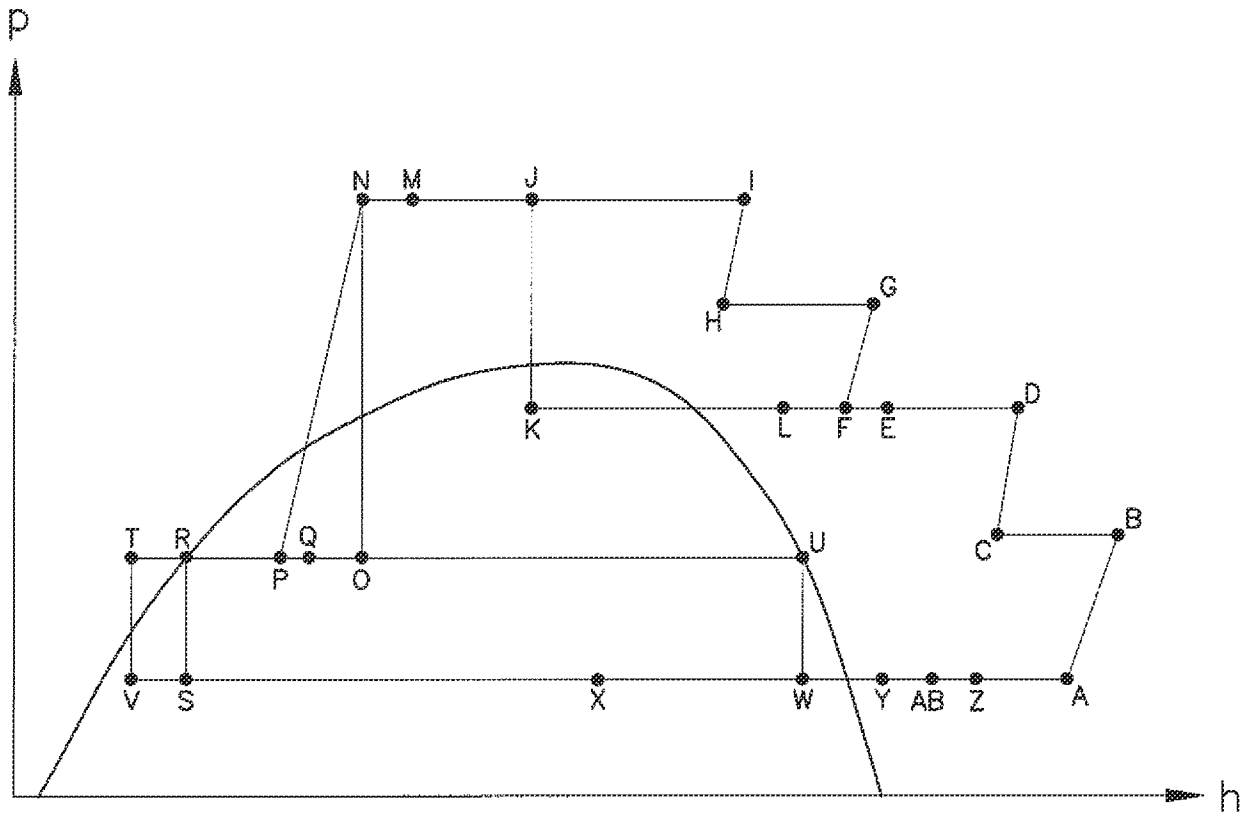
FIG. 3 is a pressure-enthalpy curve of the refrigeration cycle in FIG. 1.
Figure 6:
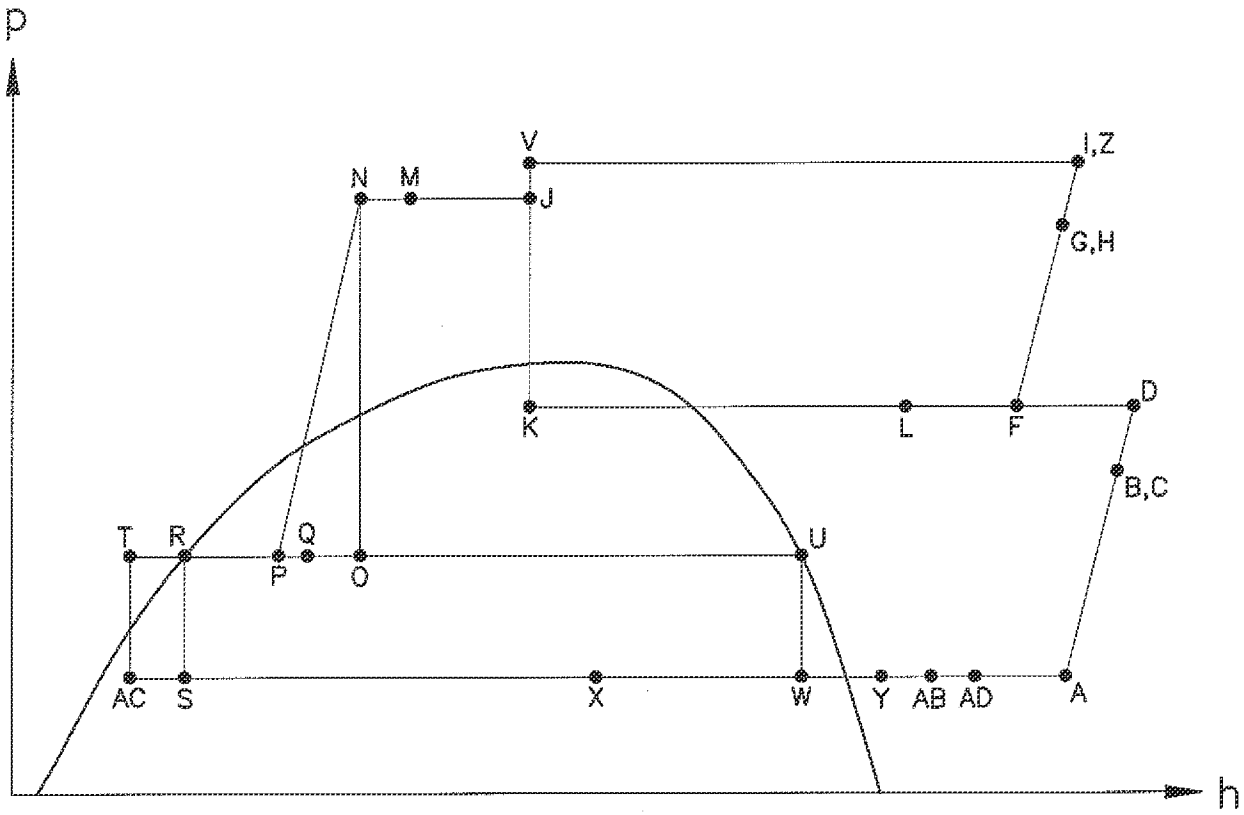
FIG. 6 is a pressure-enthalpy curve of the refrigeration cycle in FIG. 4.

The operation of the air-conditioning apparatus 1 is described while referring to FIGS. 1 to 6. FIG. 3 is a pressure-enthalpy curve (p-h curve) of the refrigeration cycle during the cooling operation. FIG. 6 is a pressure-enthalpy curve (p-h curve) of the refrigeration cycle during the heating operation. In FIGS. 3 and 6, the upwardly bulging curves are a refrigerant saturated liquid curve and a dry saturated vapor curve. In FIGS. 3 and 6, the points assigned alphabetic characters on the refrigeration cycle respectively represent the pressure of refrigerant and enthalpy at the points represented by the same alphabetic characters in FIGS. 1 and 4. For example, the refrigerant at point B in FIG. 1 has the pressure and enthalpy at point B in FIG. 3. Operation control during the cooling operation and the heating operation of the air-conditioning apparatus 1 is performed by the control unit.

(2-1) Operation During the Cooling Operation

During the cooling operation, the refrigerant circulates inside the refrigerant circuit 10 in the order of the four-stage compressor 2, outdoor heat exchanger 5, expansion mechanism 7, and indoor heat exchanger 9, following the arrows indicated in FIG. 1. The operation of the air-conditioning apparatus 1 during the cooling operation is described below while referring to FIGS. 1 to 3.

First, the low-pressure refrigerant inside the first intake pipe 101*a* is compressed in the first compression mechanism 21, and is blown out to the first blow-out pipe 101*b* (points A and B). The compressed refrigerant passes through the first switching mechanism 31 and then flows in the first oil separation pipe 111, and the lubricating oil is separated in the first oil separator 41. The refrigerant having the lubricating oil separated is cooled in the first intercooler 51, and is then supplied to the second intake pipe 102*a* by way of the first intercooler pipe 131 (points B and C). The lubricating oil separated in the first oil separator 41 goes by way of the first oil return pipe 121 and the first cooling oil return pipe 121*a* and merges into the refrigerant flowing in the first intercooler pipe 131 as illustrated in FIG. 2.

Next, the refrigerant inside the second intake pipe 102*a* is compressed in the second compression mechanism 22, and is blown out to the second blow-out pipe 102*b* (points C and D). The compressed refrigerant passes through the second switching mechanism 32 and then flows in the second oil separation pipe 112, and the lubricating oil is separated in the second oil separator 42. The refrigerant having the lubricating oil separated is cooled in the second intercooler 52, and is then supplied to the second intercooler pipe 132 (points D and E). The refrigerant flowing in the second intercooler pipe 132 is subjected to heat exchange in the economizer heat exchanger 6*a*, then merges with the intermediate-pressure refrigerant flowing in the first intermediate-pressure refrigerant pipe 151, and is supplied to the third intake pipe 103*a* (points E and F). The lubricating oil separated in the second oil separator 42 goes by way of the second oil return pipe 122 and the second cooling oil return pipe 122*a* and merges into the refrigerant flowing in the second intercooler pipe 132 as illustrated in FIG. 2.

Next, the refrigerant inside the third intake pipe 103*a* is compressed in the third compression mechanism 23, and is blown out to the third blow-out pipe 103*b* (points F and G). The compressed refrigerant passes through the third switching mechanism 33 and then flows in the third oil separation pipe 113, and the lubricating oil is separated in the third oil separator 43. The refrigerant having the lubricating oil separated is cooled in the third intercooler 53, and is then supplied to the fourth intake pipe 104*a* by way of the third intercooler pipe 133 (points G and H). The lubricating oil separated in the third oil separator 43 goes by way of the third oil return pipe 123 and the third cooling oil return pipe 123*a* and merges into the refrigerant flowing in the third intercooler pipe 133 as illustrated in FIG. 2.

Next, the refrigerant inside the fourth intake pipe 104*a* is compressed in the fourth compression mechanism 24, and is blown out to the fourth blow-out pipe 104*b* (points H and I). The lubricating oil in the high-pressure refrigerant flowing in the fourth blow-out pipe 104*b* is separated in the fourth oil separator 44. The high-pressure refrigerant having the lubricating oil separated passes through the fourth switching mechanism 34, is then supplied to the gas cooler pipe 134, and is sent to the gas cooler 54. The high-pressure refrigerant cooled in the gas cooler 54 is supplied to the high-pressure refrigerant pipe 141 (points I and J). The lubricating oil separated in the fourth oil separator 44 is returned to the first intake pipe 101*a*.

Next, the refrigerant inside the high-pressure refrigerant pipe 141 is subjected to heat exchange in the economizer heat exchanger 6*a* and the liquid-gas heat exchanger 6*b*, then passes through the expansion mechanism 7 and becomes intermediate-pressure refrigerant, and is sent to the receiver 8 by way of the second intermediate-pressure refrigerant pipe 152 (points J and M to Q). Meanwhile, the refrigerant diverted from the high-pressure refrigerant pipe 141 to the first intermediate-pressure refrigerant pipe 151 is subjected to heat exchange in the economizer heat exchanger 6*a*, and is then supplied to the second intercooler pipe 132 (points J to L). The intermediate-pressure refrigerant in a liquid-gas two-phase state sent to the receiver 8 is separated into liquid refrigerant and gas refrigerant (points Q, R, and U).

Next, the liquid refrigerant separated in the receiver 8 flows in the third intermediate-pressure refrigerant pipe 153, and is subjected to heat exchange in the super-cooling heat exchanger 6*c* (points R and T). Meanwhile, the gas refrigerant separated in the receiver 8 passes through the third expansion valve 173 and becomes low-pressure gas refrigerant (points U and W). A part of the refrigerant flowing in the third intermediate-pressure refrigerant pipe 153 also passes through the fourth expansion valve 174 and becomes low-pressure gas refrigerant (points R and S). These portions of low-pressure gas refrigerant merge (points S, W, and X), and the merged refrigerant is then subjected to heat exchange in the super-cooling heat exchanger 6*c*, and is supplied to the low-pressure refrigerant pipe 161 (points X, Y, and AB).

Next, the intermediate-pressure refrigerant subjected to heat exchange in the super-cooling heat exchanger 6*c* is supplied to the first indoor heat exchange pipe 191 and diverted, and then passes through each fifth expansion valve 175 and becomes low-pressure refrigerant (points T and V). These portions of low-pressure refrigerant are heated in each indoor heat exchange unit 9*a*, 9*b*, . . . of the indoor heat exchanger 9, and are supplied to each bypass pipe on the second indoor heat exchange pipe 192 (points V and Z). The heated low-pressure refrigerant then merges, and is supplied to the low-pressure refrigerant pipe 161 by way of the fourth switching mechanism 34 (points Z and AB).

Finally, the low-pressure refrigerant flowing in the low-pressure refrigerant pipe 161 is subjected to heat exchange in the liquid-gas heat exchanger 6*b*, and is then supplied to the first intake pipe 101*a* (points AB and A). The refrigerant circuit 10 of the air-conditioning apparatus 1 carries out the cooling operation cycle by circulation of the refrigerant inside the refrigerant circuit 10 in the above manner.

(2-2) Operation During the Heating Operation

During the heating operation, the refrigerant circulates inside the refrigerant circuit 10 in the order of the four-stage compressor 2, indoor heat exchanger 9, expansion mechanism 7, and outdoor heat exchanger 5, following the arrows indicated in FIG. 4. The operation of the air-conditioning apparatus 1 during the heating operation is described below while referring to FIGS. 4 to 6.

First, the low-pressure refrigerant inside the first intake pipe 101*a* is compressed in the first compression mechanism 21, and is blown out to the first blow-out pipe 101*b* (points A and B). The compressed refrigerant passes through the first switching mechanism 31 and is then supplied to the second intake pipe 102*a* (points B and C).

Next, the refrigerant inside the second intake pipe 102*a* is compressed in the second compression mechanism 22, and is blown out to the second blow-out pipe 102*b* (points C and D). The compressed refrigerant passes through the second switching mechanism 32, and is then supplied to the third intake pipe 103*a* (points D and F). The refrigerant flowing in the third intake pipe 103*a* is subjected to heat exchange in the economizer heat exchanger 6*a*, and merges with the intermediate-pressure refrigerant flowing in the first intermediate-pressure refrigerant pipe 151 and the second intercooler pipe 132.

Next, the refrigerant inside the third intake pipe 103*a* is compressed in the third compression mechanism 23, and is blown out to the third blow-out pipe 103*b* (points F and G). The compressed refrigerant passes through the third switching mechanism 33, and is then supplied to the fourth intake pipe 104*a* (points G and H).

Next, the refrigerant inside the fourth intake pipe 104*a* is compressed in the fourth compression mechanism 24, and is blown out to the fourth blow-out pipe 104*b* (points H and I).

The lubricating oil in the high-pressure refrigerant flowing in the fourth blow-out pipe 104*b* is separated in the fourth oil separator 44. The high-pressure refrigerant having the lubricating oil separated passes through the fourth switching mechanism 34, and is then supplied to each bypass pipe on the second indoor heat exchange pipe 192 (points I and Z). The lubricating oil separated in the fourth oil separator 44 is returned to the first intake pipe 101*a*.

Next, the high-pressure refrigerant inside each bypass pipe on the second indoor heat exchange pipe 192 is cooled in each indoor heat exchange unit 9*a*, 9*b*, . . . of the indoor heat exchanger 9 (points Z and V). The cooled high-pressure refrigerant passes through the fifth expansion valve 175 in each bypass pipe on the first indoor heat exchange pipe 191 and is slightly depressurized, then the refrigerant merges and is supplied to the high-pressure refrigerant pipe 141 (points V and J).

Next, the refrigerant inside the high-pressure refrigerant pipe 141 is subjected to heat exchange in the economizer heat exchanger 6*a* and the liquid-gas heat exchanger 6*b*, then passes through the expansion mechanism 7 and becomes intermediate-pressure refrigerant, and is sent to the receiver 8 by way of the second intermediate-pressure refrigerant pipe 152 (points J and M to Q). Meanwhile, the refrigerant diverted from the high-pressure refrigerant pipe 141 to the first intermediate-pressure refrigerant pipe 151 is subjected to heat exchange in the economizer heat exchanger 6*a*, and is then supplied to the third intake pipe 103*a* by way of the second intercooler pipe 132 (points J to L). The intermediate-pressure refrigerant in a liquid-gas two-phase state sent to the receiver 8 is separated into liquid refrigerant and gas refrigerant (points Q, R, and U).

Next, the liquid refrigerant separated in the receiver 8 flows in the third intermediate-pressure refrigerant pipe 153, and is subjected to heat exchange in the super-cooling heat exchanger 6*c* (points R and T). Meanwhile, the gas refrigerant separated in the receiver 8 passes through the third expansion valve 173 and becomes low-pressure gas refrigerant (points U and W). A portion of the refrigerant flowing in the third intermediate-pressure refrigerant pipe 153 also passes through the fourth expansion valve 174 and becomes low-pressure gas refrigerant (points R and S). These portions of low-pressure gas refrigerant merge (points S, W, and X), and the merged refrigerant is then subjected to heat exchange in the super-cooling heat exchanger 6*c*, and is supplied to the low-pressure refrigerant pipe 161 (points X, Y, and AB).

Next, the intermediate-pressure refrigerant subjected to heat exchange in the super-cooling heat exchanger 6*c* passes through a sixth expansion valve 176 and becomes low-pressure refrigerant (points T and AC) as illustrated in FIG. 4. The low-pressure refrigerant passes through a shunt 81 and is diverted to four refrigerant channels. The four refrigerant flows pass through the first intercooler 51, second intercooler 52, third intercooler 53, and gas cooler 54, respectively. The low-pressure refrigerant passing through the gas cooler 54 passes through the fourth switching mechanism 34, and is supplied to the low-pressure refrigerant pipe 161 (points AC and AD). Meanwhile, the portions of low-pressure refrigerant passing through the first intercooler 51, second intercooler 52, and third intercooler 53 are supplied to the first oil separation pipe 111, second oil separation pipe 112, and third oil separation pipe 113, respectively. The lubricating oil in the low-pressure refrigerant inside the first oil separation pipe 111 is separated in the first oil separator 41, then the refrigerant passes through the first switching mechanism 31, and is supplied to the low-pressure refrigerant pipe 161 (points AC and AD). The lubricating oil separated in the first oil separator 41 goes by way of the first oil return pipe 121 and the first heating oil return pipe 121*b* and again merges into the first oil separation pipe 111 as illustrated in FIG. 5. The lubricating oil in the low-pressure refrigerant inside the second oil separation pipe 112 likewise is separated in the second oil separator 42, then the refrigerant passes through the second switching mechanism 32, and is supplied to the low-pressure refrigerant pipe 161 (points AC and AD). The lubricating oil separated in the second oil separator 42 goes by way of the second oil return pipe 122 and the first heating oil return pipe 122*b* and again merges into the second oil separation pipe 112 as illustrated in FIG. 5. The lubricating oil in the low-pressure refrigerant inside the third oil separation pipe 113 likewise is separated in the third oil separator 43, then the refrigerant passes through the third switching mechanism 33, and is supplied to the low-pressure refrigerant pipe 161 (points AC and AD). The lubricating oil separated in the third oil separator 43 goes by way of the third oil return pipe 123 and the third heating oil return pipe 123*b* and again merges into the third oil separation pipe 113 as illustrated in FIG. 5. The low-pressure refrigerant passing through each switching mechanism 31 to 34 merges with the low-pressure refrigerant subjected to heat exchange in the super-cooling heat exchanger 6*c* (points AD and AB).

Finally, the low-pressure refrigerant flowing in the low-pressure refrigerant pipe 161 is subjected to heat exchange in the liquid-gas heat exchanger 6*b*, and is then supplied to the first intake pipe 101*a* (points AB and A). The refrigerant circuit 10 of the air-conditioning apparatus 1 carries out the heating operation cycle by circulation of the refrigerant inside the refrigerant circuit 10 in the above manner.

(3) Features of the Air-Conditioning Apparatus

In the refrigerant circuit 10 of the air-conditioning apparatus 1 according to the present embodiment, the first oil separator 41 is placed between the first switching mechanism 31 and the first intercooler 51, the second oil separator 42 is placed between the second switching mechanism 32 and the second intercooler 52, and the third oil separator 43 is placed between the third switching mechanism 33 and the third intercooler 53.

In the present embodiment, during the cooling operation, the refrigerant compressed by the first compression mechanism 21 passes through the first switching mechanism 31, and the lubricating oil is then separated in the first oil separator 41. The refrigerant compressed by the second compression mechanism 22 likewise passes through the second switching mechanism 32, and the lubricating oil is then separated in the second oil separator 42. The refrigerant compressed by the third compression mechanism 23 likewise passes through the third switching mechanism 33, and the lubricating oil is then separated in the third oil separator 43. During the cooling operation, the refrigerant compressed by the first compression mechanism 21, second compression mechanism 22 and third compression mechanism 23 passes through the first intercooler 51, second intercooler 52, and third intercooler 53, respectively, and is cooled. That is, the lubricating oil contained in the compressed refrigerant is separated in the first oil separator 41, second oil separator 42, and third oil separator 43 in order to suppress degradation of the efficiency of cooling the refrigerant in the first intercooler 51, second intercooler 52, and third intercooler 53. The lubricating oil separated by the first oil separator 41, second oil separator 42, and third oil separator 43 merges with the refrigerant passing through the first intercooler 51, second intercooler 52, and third intercooler 53, respectively.

In the present embodiment, during the heating operation, the refrigerant compressed by the first compression mechanism 21 is sent to the second compression mechanism 22 without being cooled. The refrigerant compressed by the second compression mechanism 22 merges with the intermediate-pressure refrigerant supplied from the economizer heat exchanger 6*a* and is cooled, and is then sent to the third compression mechanism 23. The refrigerant compressed by the third compression mechanism 23 is sent to the fourth compression mechanism 24 without being cooled. The lubricating oil in the refrigerant compressed by the fourth compression mechanism 24 is separated in the fourth oil separator 44, and the refrigerant is then cooled in the indoor heat exchanger 9. Thus, during the heating operation, the refrigerant compressed by the first compression mechanism 21, second compression mechanism 22, and third compression mechanism 23 is not cooled in the first intercooler 51, second intercooler 52, and third intercooler 53, respectively. Therefore, during the heating operation, being different from during the cooling operation, there is no requirement to separate the lubricating oil from the refrigerant compressed by the first compression mechanism 21, second compression mechanism 22, and third compression mechanism 23.

In the present embodiment, during the heating operation, the refrigerant compressed by the first compression mechanism 21, second compression mechanism 22, and third compression mechanism 23 is sent to a compression mechanism at a higher stage without passing through the first oil separator 41, second oil separator 42, and third oil separator 43, respectively. Therefore, the refrigerant compressed by the first compression mechanism 21, second compression mechanism 22, and third compression mechanism 23 does not release heat in the first oil separator 41, second oil separator 42, and third oil separator 43, which are placed inside an outdoor unit of the air-conditioning apparatus 1.

An air-conditioning apparatus 1 as a comparative example is imagined here, being an air-conditioning apparatus in which the first oil separator 41, second oil separator 42, and third oil separator 43 are placed between the first compression mechanism 21 and the first switching mechanism 31, between the second compression mechanism 22 and the second switching mechanism 32, and between the third compression mechanism 23 and the third switching mechanism 33, respectively. In the refrigerant circuit 10 of this air-conditioning apparatus, during the heating operation as well, the refrigerant compressed by the first compression mechanism 21, second compression mechanism 22, and third compression mechanism 23 passes through the first oil separator 41, second oil separator 42, and third oil separator 43, respectively. At this time, the compressed refrigerant is exposed to low-temperature external air, and therefore incurs thermal loss due to release of heat by the refrigerant.

Accordingly, in the air-conditioning apparatus 1 according to the present embodiment, the refrigerant compressed by the compression mechanisms 21 to 23 at each stage other than that of the highest stage is sent to the compression mechanism 22 to 24 at a higher stage without passing through the oil separators 41 to 43, and therefore exothermic loss during the heating operation can be suppressed. The operating efficiency of the air-conditioning apparatus 1 can thereby be improved.

(4) Modifications (4-1) Modification A

In the present embodiment, the refrigerant circuit 10 of the air-conditioning apparatus 1 is provided with a four-stage compressor 2 in which a first compression mechanism 21, a second compression mechanism 22, a third compression mechanism 23, and a fourth compression mechanism 24 are connected in series. However, the refrigerant circuit 10 may be provided with a multistage compressor having a configuration in which two or more compression mechanisms are connected in series instead of a four-stage compressor 2. In the present modification as well, during the heating operation, the refrigerant compressed by a compression mechanism excluding the compression mechanism at the highest stage of the multistage compressor is sent to a compression mechanism at a higher stage without passing through an oil separator. Exothermic loss during the heating operation can thereby be suppressed.

(4-2) Modification B

In the present embodiment, the four-stage compressor 2 of the air-conditioning apparatus 1 includes the first compression mechanism 21, the second compression mechanism 22, the third compression mechanism 23, and the fourth compression mechanism 24, and these compression mechanisms are rotary-type compression mechanisms, but these compression mechanisms may be, for example, scroll-type compression mechanisms.

(4-3) Modification C

In the present embodiment, the switching mechanisms 31 to 34 are a four-way switching valve, but the switching mechanism may be, for example, a mechanism in which a function to switch between a cooling operation cycle and a heating operation cycle is provided by combining a plurality of electromagnetic valves.

(4-4) Modification D

In the present embodiment, the refrigerant circuit 10 of the air-conditioning apparatus 1 uses a carbon dioxide refrigerant, but another refrigerant may be used.

Industrial Applicability

In the refrigeration apparatus according to the present invention, exothermic loss can be suppressed.

What is claimed is:

1. A refrigeration apparatus, comprising:

a multistage compression mechanism having one high-stage-side compression mechanism and a plurality of low-stage-side compression mechanisms connected in series;

switching mechanisms connected to blow-out pipes of the low-stage-side compression mechanisms, the switching mechanisms being configured to switch between a cooling operation cycle and a heating operation cycle;

intercoolers configured to cool refrigerant blown out from the low-stage-side compression mechanisms during the cooling operation cycle;

low-stage-side oil separators disposed between the switching mechanisms and the intercoolers, the low-stage-side oil separators being configured to separate a lubricating oil from the refrigerant blown out from the low-stage-side compression mechanisms during the cooling operation cycle; and a control unit configured to control the multistage compression mechanism and the switching mechanisms, during the cooling operation cycle, the refrigerant blown out from each of the low-stage-side compression mechanisms passing through one of the low-stage-side oil separators and one of the intercoolers before being taken into another of the low-stage-side compression mechanisms or the high-stage-side compression mechanism; and during the heating operation cycle, the refrigerant blown out from each of the low-stage-side compression mechanisms not passing through one of the low-stage-side oil separators and one of the intercoolers before being taken into another of the low-stage-side compression mechanisms or the high-stage-side compression mechanism.

2. The refrigeration apparatus according to claim 1, further comprising a high-stage-side oil separator connected to a blow-out pipe of the high-stage-side compression mechanism, the high-stage-side oil separator being configured to separate the lubricating oil from the refrigerant blown out from the high-stage-side compression mechanism.

3. The refrigeration apparatus according claim 2, wherein the low-stage-side compression mechanisms include a first low-stage-side compression mechanism, a second tow-stage-side compression mechanism, and a third low-stage-side compression mechanism; and the high-stage-side compression mechanism, the first low-stage-side compression mechanism, the second low-stage-side compression mechanism, and the third low-stage-side compression mechanism are connected in series in order in the multistage compression mechanism.

4. The refrigeration apparatus according to claim 2, further comprising cooling oil return lines through which the lubricating oil separated from the refrigerant in the low-stage-side oil separators is returned to intercooler blow-out sides of the intercoolers connected to the low-stage-side oil separators during the cooling operation cycle; and heating oil return lines through which the lubricating oil separated from the refrigerant in the low-stage-side oil separators is returned to refrigerant blow-out sides of the low-stage-side oil separators during the heating operation cycle.

5. The refrigeration apparatus according claim 4, wherein the low-stage-side compression mechanisms include a first low-stage-side compression mechanism, a second tow-stage-side compression mechanism, and a third low-stage-side compression mechanism; and the high-stage-side compression mechanism, the first low-stage-side compression mechanism, the second low-stage-side compression mechanism, and the third low-stage-side compression mechanism are connected in series in order in the multistage compression mechanism.

6. The refrigeration apparatus according to claim 4, wherein the cooling oil return lines have cooling backflow prevention mechanisms that allow only a flow of the lubricating oil during the cooling operation cycle; and the heating oil return lines have heating backflow prevention mechanisms that allow only a flow of the lubricating oil during the heating operation cycle.

7. The refrigeration apparatus according claim 6, wherein the low-stage-side compression mechanisms include a first low-stage-side compression mechanism, a second low-stage-side compression mechanism, and a third low-stage-side compression mechanism; and the high-stage-side compression mechanism, the first low-stage-side compression mechanism, the second low-stage-side compression mechanism, and the third low-stage-side compression mechanism are connected in series in order in the multistage compression mechanism.

8. The refrigeration apparatus according to claim 1, further comprising cooling oil return lines through which the lubricating oil separated from the refrigerant in the low-stage-side oil separators is returned to intercooler blow-out sides of the intercoolers connected to the low-stage-side oil separators during the cooling operation cycle; and heating oil return lines through which the lubricating oil separated from the refrigerant in the low-stage-side oil separators is returned to refrigerant blow-out sides of the low-stage-side oil separators during the heating operation cycle.

9. The refrigeration apparatus according claim 8, wherein the low-stage-side compression mechanisms include a first low-stage-side compression mechanism, a second low-stage-side compression mechanism, and a third low-stage-side compression mechanism; and the high-stage-side compression mechanism, the first low-stage-side compression mechanism, the second low-stage-side compression mechanism, and the third low-stage-side compression mechanism are connected in series in order in the multistage compression mechanism.

10. The refrigeration apparatus according to claim 8, wherein the cooling oil return lines have cooling backflow prevention mechanisms that allow only a flow of the lubricating oil during the cooling operation cycle; and the heating oil return lines have heating backflow prevention mechanisms that allow only a flow of the lubricating oil during the heating operation cycle.

11. The refrigeration apparatus according claim 10, wherein the low-stage-side compression mechanisms include a first low-stage-side compression mechanism, a second low-stage-side compression mechanism, and a third tow-stage-side compression mechanism; and the high-stage-side compression mechanism, the first low-stage-side compression mechanism, the second low-stage-side compression mechanism, and the third low-stage-side compression mechanism are connected in series in order in the multistage compression mechanism.

12. The refrigeration apparatus according to claim 1, wherein the low-stage-side compression mechanisms include a first low-stage-side compression mechanism, a second low-stage-side compression mechanism, and a third low-stage-side compression mechanism; and the high-stage-side compression mechanism, the first low-stage-side compression mechanism, the second low-stage-side compression mechanism, and the third low-stage-side compression mechanism are connected in series in order in the multistage compression mechanism.

* * * * *